US005794589A

United States Patent [19]

Håkansson

[11] Patent Number: 5,794,589

[45] Date of Patent: Aug. 18, 1998

[54] EXHAUST VALVE MECHANISM IN AN INTERNAL COMBUSTION ENGINE

[75] Inventor: Nils Olof Håkansson, Stenkullen, Sweden

[73] Assignee: AB Volvo, Gothenburg, Sweden

[21] Appl. No.: 755,561

[22] Filed: Nov. 25, 1996

[30] Foreign Application Priority Data

Nov. 24, 1995 [SE] Sweden ..... 9504210

[51] Int. Cl.[6] ..... F02D 13/04; F01L 1/24

[52] U.S. Cl. ..... 123/321; 123/90.46

[58] Field of Search ..... 123/321, 322, 123/182.1, 90.12, 90.15, 90.16, 90.44, 90.46, 90.39, 90.6

[56] References Cited

U.S. PATENT DOCUMENTS

| | | | |
|---|---|---|---|
| Re. 33,052 | 9/1989 | Meistrick et al. | 123/321 |
| 2,002,196 | 5/1935 | Ucko | 123/321 |
| 3,220,392 | 11/1965 | Cummins . | |
| 3,809,033 | 5/1974 | Cartledge | 123/90.46 |
| 4,134,371 | 1/1979 | Hausknecht | 123/90.43 |
| 5,357,926 | 10/1994 | Hu | 123/321 |
| 5,609,133 | 3/1997 | Hakansson | 123/321 |

FOREIGN PATENT DOCUMENTS

| | | |
|---|---|---|
| 149409 | 6/1986 | Denmark . |
| 0 167 267 | 1/1986 | European Pat. Off. . |
| 0 638 707 | 2/1995 | European Pat. Off. . |
| 0 702 133 | 3/1996 | European Pat. Off. . |

*Primary Examiner*—Willis R. Wolfe
*Assistant Examiner*—Hieu T. Vo
*Attorney, Agent, or Firm*—Young & Thompson

[57] ABSTRACT

Exhaust valve mechanism in an internal combustion engine, comprising a piston-cylinder device (21,22) width a securely mounted cylinder (21), the piston (22) of which has a piston rod (37) which extends through a bore (38) in a rocker arm (8) and is directed towards the spindle end (6) of the exhaust valve (1). A valve (23) in a hydraulic circuit is controlled by the movement of the rocker arm and is arranged, when there is overpressure in the hydraulic circuit, to conduct pressure fluid to and from the cylinder (21) to open and close the exhaust valve (1) at a stroke other than the exhaust stroke.

11 Claims, 2 Drawing Sheets

EXHAUST VALVE MECHANISM IN AN INTERNAL COMBUSTION ENGINE

BACKGROUND OF THE INVENTION

The present invention relates to an exhaust valve mechanism in an internal combustion engine, comprising at least one exhaust valve in each cylinder, for each cylinder a rocker arm mounted on a rocker arm shalt for operating the exhaust valve, a cam shaft, a cam element for each rocker arm, said cam clement cooperating with means imparting a rocking movement to the rocker arm as the cam shaft rotates, and a hydraulic circuit with valve means and force-actuated means, which are actuatable to open the exhaust valve during engine stroke other than the exhaust stroke SE-A-468 132 describes an exhaust valve mechanism of the above mentioned type, which together with a special type of cam shaft with an extra small cam lobe can be used to increase the braking effect of the engine. The extra cam lobe is dimensioned so that its lift height approximately corresponds to the normal valve play in the valve mechanism. By reducing the valve play to zero by means of the valve play take-up mechanism, an extra lift of the exhaust valve can be obtained corresponding to the normal valve play during a suitable time interval. For example, the extra cam lobe can be so placed relative to the ordinary cam lobe, that an extra exhaust valve lift is obtained during a latter portion of the compression stroke, which results in a portion of the compression work during the compression stroke being lost and not being recovered during the expansion stroke. The result will be an increase in engine braking power.

In another valve mechanism known by PCT/SE 94/00370 of the type described by way of introduction, the mechanical drive device described above in the form of an extra cam lobe on the cam shaft cam element is replaced by a hydraulic drive device which is driven by the ordinary cam lobe of the cam element. Through this arrangement it is possible to control the closing of the exhaust valve, so that it will be identical for drive mode and brake mode, which is not possible in the first mentioned mechanism, where maximum lift of the exhaust valve cannot be used in drive mode.

Common to the two known exhaust valve mechanisms is that they use a valve play take-up device in the form of a hydraulic piston in a cylinder chamber in one end of the rocker arm. The piston has a pressure surface which presses against the end of the valve spindle of the exhaust valve. This means that the reactive force to the opening force acting on the exhaust valve spindle will be propagated through the entire valve system. In particular, the surface pressure between the cam element and a cam roller in contact therewith can be relatively high, when the valve is used as a decompression valve, i.e. opening against a high compression pressure.

SUMMARY OF THE INVENTION

The purpose of the present invention is to achieve an exhaust valve mechanism of the type described by way of introduction, which can be used for higher braking power than those for which the limit is set by the maximum allowable surface pressure between the various components of the valve system.

This is achieved according to the invention by virtue of the fact that the force-actuated means are so disposed that the reactive force to the force of the force-actuated means in the opening direction of the exhaust valve is taken up by elements outside the valve mechanism.

The invention is based on the principle that the cam shaft is used in the conventional manner to only open the exhaust valve at the ordinary engine exhaust stroke, while otherwise the rotation of the cam shaft in brake mode is only used to control those valve means which in turn control the force-actuated means.

In a preferred embodiment of the valve mechanism according to the invention, the force-actuated means are a hydraulic piston cylinder device, which has a piston rod extending through a bore in the rocker arm, said bore opening at a pressure surface facing an end surface on a valve spindle joined to the exhaust valve, and the cylinder of the piston-cylinder device is fixed to a stationary portion of the engine above the rocker arm.

The principal difference between the design according to the invention and the known valve mechanism described in the introduction is that the cylinder of the piston, which opens the exhaust valve at another work stroke than the exhaust stroke, is located in a fixed portion of the engine and not in the end of the rocker arm, but that the piston rod of the piston in brake mode pushes, as previously, against the spindle end of the exhaust valve. In addition to the advantage of the valve mechanism according to the invention that no extra forces are propagated to the various components of the mechanism in brake mode, an additional substantial advantage is achieved, namely that the lift curve of the exhaust valve in drive mode need not be affected when a conventional valve mechanism in an engine is replaced by an exhaust valve mechanism according to the present invention. The lift curves in drive mode and brake mode can thus be identical.

BRIEF DESCRIPTION OF THE DRAWINGS

The invention will be described in more detail with reference to examples shown in the accompanying drawings, where.

DESCRIPTION OF PREFERRED EMBODIMENT

Figure 1:
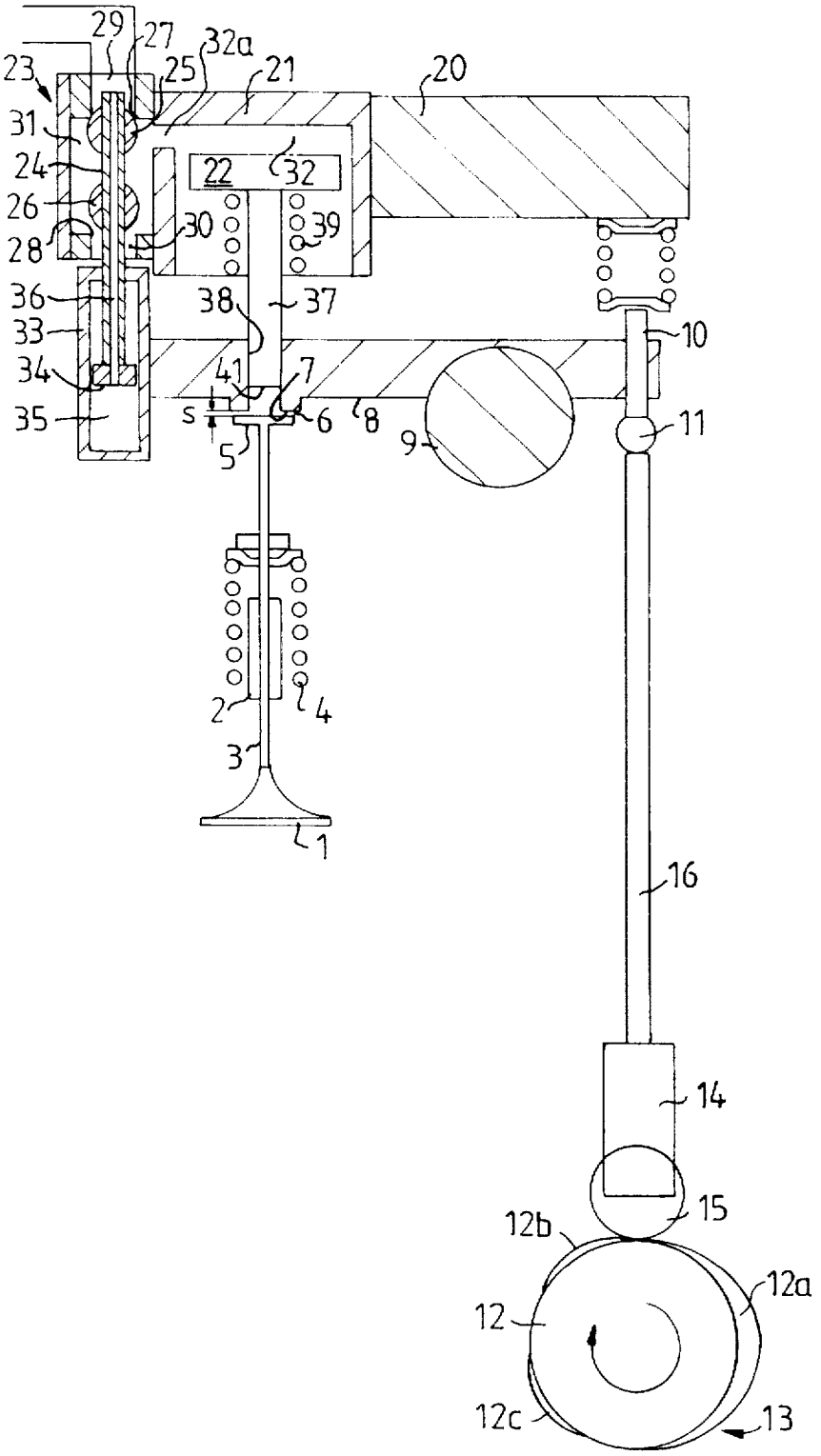
FIG. 1 shows a schematic side view of one embodiment of an exhaust valve mechanism according to the invention.

Element 1 in FIG. 1 designates an exhaust valve in a cylinder (not shown in more detail here) in an internal combustion engine. The valve 1 has a spindle 3 displaceable in a valve guide 2 and is biased towards the closed position by a valve spring 4. The distal end of the spindle 3 has a disc 5 with an upwardly facing surface 6 located facing a pressure surface 7 on a rocker arm 8, which is pivotally mounted on a rocker arm shaft 9. At one end of the rocker arm 8, there is a play adjustment screw 10 with a ball 11 in a threaded bore. The engine for which the valve mechanism is designed is a push rod engine, and the rocker arm 8 is imparted a rocking motion by a cam element 12 on a cam shaft 13 mounted in the engine block, via a valve lifter 14 with a cam follower 15 and a push rod 16.

In a fixed portion of the engine, for example in a bridge 20 on top of the engine cylinder head, a cylinder 21 with a piston 22 and a valve 23 are securely mounted. The valve 23 has two valve elements 25,26 fixed to a spindle 24. The valve elements can be brought into sealing contact with seats 27 and 28, respectively, about an inlet 29 from an oil pressure source or an outlet 30 to the engine oil system on the suction side, respectively. The chamber 31 of the valve 23 communicates with the cylinder chamber 32 of the cylinder 21 via a channel 32*a*. The valve spindle 24 extends into a cylinder 33 which is securely joined to the rocker arm 8 and is securely joined at its distal end to a piston element 34 which is disposed with a certain small play in the cylinder chamber 35 of the cylinder 33. The cylinder chamber 35 is in communication via a channel 36 in the spindle 24 with the valve inlet 29. The cylinder chamber 35 has a cross-sectional area which is slightly larger than the cross-sectional area of the inlet 29 and the cross-sectional area of the outlet 30.

The piston 22 is joined to a piston rod 37 which extends into a bore 38 in the rocker arm. Said bore opens centrally into the pressure surface 7 of the rocker arm B. The piston 22 is loaded by a spring 39 in the position shown in FIG. 1, in which its distal end 41 lies inside the pressure surface 7 when the cam follower 15 is in contact with the circular cam curve portion of the cam element 12 between the ordinary lift lobe 12*a* and a so-called charge lobe 12*b*, after which there follows a so-called decompression lobe 12*c*. Between the upwardly facing surface 6 of the spindle disc 5 and the pressure surface 7 of the rocker arm, there is in this position a valve play "s" corresponding to the height of the lobes 12*b* and 12*c*.

As an alternative to a piston rod 37 extending through a bore 38 in the rocker arm 8, a piston rod (not shown) with two forks can be used, between which the rocker arm 8 extends, thus eliminating the bore 38.

Figures 2, 3:
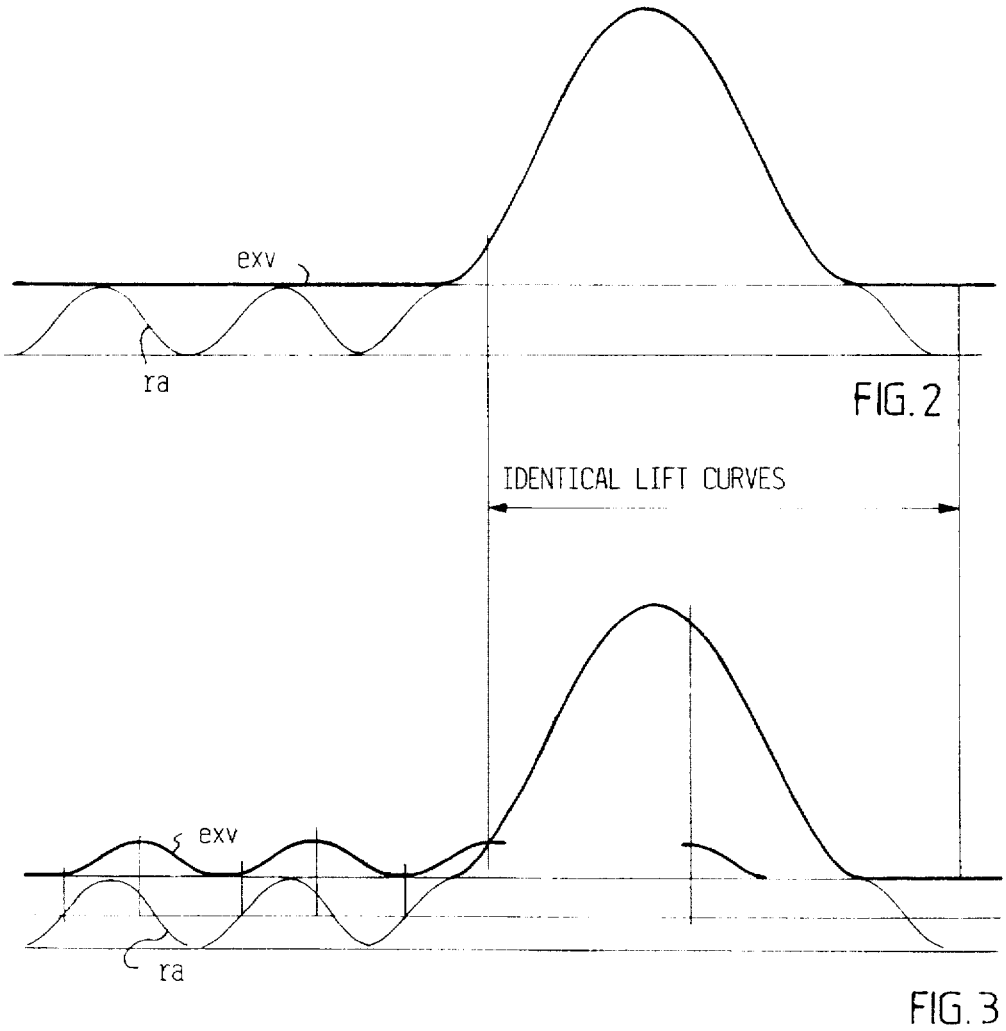
FIG. 2 shows the lift curve of the exhaust valve in drive mode.
FIG. 3 shows the lift curve of the exhaust valve in brake mode.

In a normal drive mode, there is no overpressure in the oil in the supply line to the inlet 29 and the opening and closing movement of the exhaust valve 1 follows the lift curve labelled "cxv" in FIG. 2, caused by the ordinary lift lobe 12*a* while the rocking movement of the rocker arm 8 follows the curve "ra" caused by the extra lobes 12*b* and 12*c*, the maximum lift thereof corresponds to the valve play "s". In drive mode, the cylinder chamber 35 is empty so that the rocker movement is not appreciably affected by the valve 23.

The transition to brake mode is done by switching means (not shown) and a very high oil pressure, e.g. on the order of 100 bar, is built up in the line to the inlet 29 of the valve 23 and in the cylinder chamber 35 on either side of the piston element 34. Due to the fact that the cylinder chamber 35 has a somewhat larger cross-sectional area than the inlet 29, the valve elements are held in the position shown until—starting from the position of the cam element 12 in FIG. 1—the charge lobe 12*b* passes the cam follower 15. The accompanying rocker movement of the rocker arm, due to the viscosity of the oil in the oil-filled chamber 35, causes the valve spindle 24 to first be pulled by the downward movement of the rocker arm 8, so that the upper valve element 24 opens the inlet 29, while the lower valve element closes the outlet 30, thus pressurizing the cylinder chamber 32. The piston 22 is pressed downwards and its piston rod end strikes the spindle disc 5 so that the exhaust valve is rapidly opened. During the upward rocking movement of the rocker arm 8, the valve spindle is moved in the opposite direction so that the inlet 29 is closed and the outlet 30 is opened, which leads to draining of the cylinder chamber 32 and return of the piston 22 to the position shown, whereupon the exhaust valve 1 closes. FIG. 3 shows the exhaust valve lift curve "exv" and the rocking movement curve "ra" of the rocker arm 8 in braking mode. The damping device formed by the cylinder 33 and the piston 34 permits the rocker arm 8 during the ordinary valve lift to continue its rocking movement downwards unimpeded by the valve spindle 24 by virtue of the fact that oil can flow from the cylinder chamber 35 above the piston 34 to the chamber below the piston when the valve has reached its bottom position. At the peak, i.e. when passing the top of the lift curve, the viscosity of the damping device will immediately reverse the valve 23 so that the cylinder 21 is drained and the piston rod 37 is returned to the position shown in FIG. 1. The result of this will be that the lift curve "exv" of the exhaust valve during the ordinary exhaust stroke in brake mode will be exactly the same as for drive mode.

I claim:

1. Exhaust valve mechanism in an internal combustion engine, comprising at least one exhaust valve in each cylinder, for each cylinder a rocker arm mounted on a rocker arm shaft for operating the exhaust valve, a cam shaft, a cam element for each rocker arm, said cam element cooperating with means imparting a rocking movement to the rocker arm as the cam shaft rotates, and a hydraulic circuit with valve means and force-actuated means, which are actuatable to open the exhaust valve during an engine stroke other than the exhaust stroke, wherein the force-actuated means (21, 22) are so disposed that a reactive force to the force of the force-actuated means in the opening direction of the exhaust a fixed portion (20) of the engine.

2. The valve mechanism according to claim 1, wherein the valve means (23) have operating means (24, 33, 34) cooperating with the rocker arm (8), said operating means, at the rocking movement of the rocker arm (8) in the opening direction of the exhaust valve, opening a communication (29) between a pressure medium source and an operating chamber (32) of the force-actuated means (21, 22) to actuate said force-actuated means to open the exhaust valve, and at the rocking movement of the rocker arm in the opposite direction, closing said communication (29) and opening a communication (30) for draining the operating chamber (32) and closing the exhaust valve (1).

3. The valve mechanism according to claim 1, wherein the force-actuated means comprise a hydraulic piston cylinder device (21, 22), which has a piston rod (37) extending through a bore (38) in the rocker arm (8), said bore opening into a pressure surface (7) facing an end surface (6) on a valve spindle (3) joined to the exhaust valve, and wherein the cylinder (21) of the piston cylinder device is fixed to the fixed engine portion (20) above the rocker arm (8).

4. The valve mechanism according to claim 1, wherein the force-actuated means comprise a hydraulic piston cylinder device (21, 22) which has a piston rod with two legs, between which the rocker arm extends, wherein the rocker arm (8) between the two legs has a pressure surface which directly faces an end surface (6) on a valve spindle (3) joined to the exhaust valve, and wherein the cylinder (21) of the piston cylinder device is fixed against the fixed engine portion (20) above the rocker arm (8).

5. The valve mechanism according to claim 3, wherein the piston cylinder device (21, 22) is single-acting and wherein its piston (22) is biased by a spring (39) to a position in which a distal end (41) of the piston rod (37) lies inside the pressure surface (7) of the rocker arm.

6. The valve mechanism according to claim 1, wherein the cam element (12) has, in addition to a lift lobe (12*a*), which opens the exhaust valve (1) during the ordinary engine exhaust stroke, at least one additional lift lobe (12*b*, 12*c*), the lift height of which corresponds to a valve play(s) of the engine.

7. The valve mechanism according to one of claim 2, wherein the operating means of the valve means (23) cooperating with the rocker arm (8) comprise a hydraulic damping device (33,34).

8. The valve mechanism according to claim 1, wherein the means cooperating with the cam element (12) comprise a cam follower (15), a valve lifter (14) and a push rod (16) arranged between the valve lifter and the rocker arm.

9. An exhaust valve mechanism for an internal combustion engine, the mechanism comprising:

an exhaust valve with an associated rocker arm for operating said exhaust valve;

force-actuated means that, in response to a force in an opening direction of said exhaust valve, provides a reactive force to a fixed portion of the engine; and operating means for opening a first communication between a pressure medium source and an operating chamber of said force-actuated means to actuate said force-actuated means to open said exhaust valve when said rocker arm moves in the opening direction, and for closing said first communication and opening a second communication for draining said operating chamber to close said exhaust valve when said rocker arm moves in a direction opposite to said opening direction.

10. The mechanism of claim 9, wherein said operating chamber of said force-actuated means comprises a cylinder affixed to the fixed portion of the engine.

11. The mechanism of claim 10, wherein said operating means comprises a damper affixed to said rocker arm and a valve spindle movable within said damper, and a valve affixed to said cylinder and in fluid communication therewith for moving said valve spindle.

* * * * *